United States Patent [19]

Belcastro, deceased et al.

[11] 4,122,999

[45] Oct. 31, 1978

[54] FORCED AIR HEATING SYSTEM

[76] Inventors: Rosario Belcastro, deceased, late of Ambridge, Pa.; by Patricia Belcastro, administratrix, 1813 3rd Ave., New Brighton, Pa. 15066

[21] Appl. No.: 778,357

[22] Filed: Mar. 17, 1977

[51] Int. Cl.[2] ..... G05D 23/00

[52] U.S. Cl. ..... 236/11; 126/110 R; 126/117

[58] Field of Search ..... 165/DIG. 2; 126/110 R, 126/117, 112; 236/11

[56] References Cited

U.S. PATENT DOCUMENTS

| | | | |
|---|---|---|---|
| 2,238,564 | 4/1941 | Macy | 126/110 R X |
| 2,307,600 | 1/1943 | Munters et al. | 237/55 |
| 2,348,569 | 5/1944 | Peters | 126/117 X |
| 2,363,742 | 11/1944 | Norton | 126/110 R |
| 2,704,571 | 3/1955 | Reichelderfer | 126/110 R X |
| 3,198,190 | 8/1965 | Gordon | 126/117 X |

*Primary Examiner*—William E. Wayner
*Assistant Examiner*—William E. Tapolcai, Jr.
*Attorney, Agent, or Firm*—Thomas H. Murray; Clifford A. Poff

[57] ABSTRACT

The flue pipe for a combustion chamber of a hot air furnace passes through the hot air plenum and then passes through the cold air supply duct. Heat exchange fins are secured to a length of the flue pipe located within the hot air plenum and within the cold air supply duct to utilize the residual heat of the flue gases to heat the air flowing around the fins. The flue pipe extends to a chimney for exhausting the gases. A sensor is located for response to the temperature of the air heated by both the flue pipe passing through the hot air distribution header and the furnace itself for energizing a driven blower. A thermostat produces a command signal to deliver fuel to the furnace burners. The blower is energized when the temperature in the hot air plenum reaches a predetermined level.

7 Claims, 4 Drawing Figures

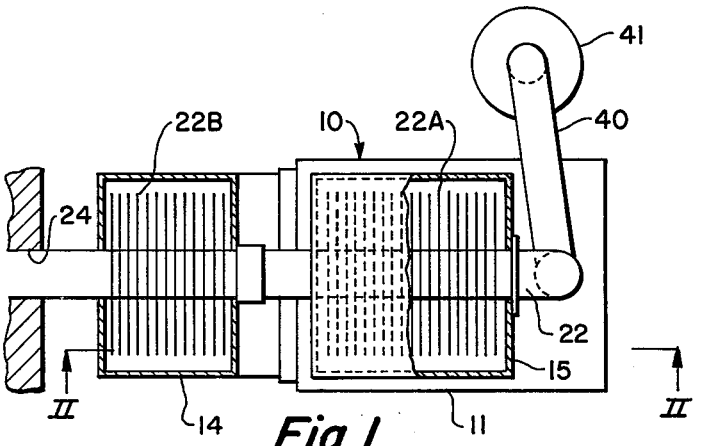
Fig. 1
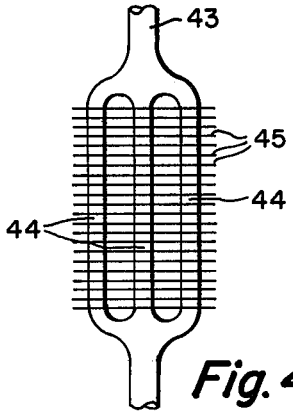
Fig. 4
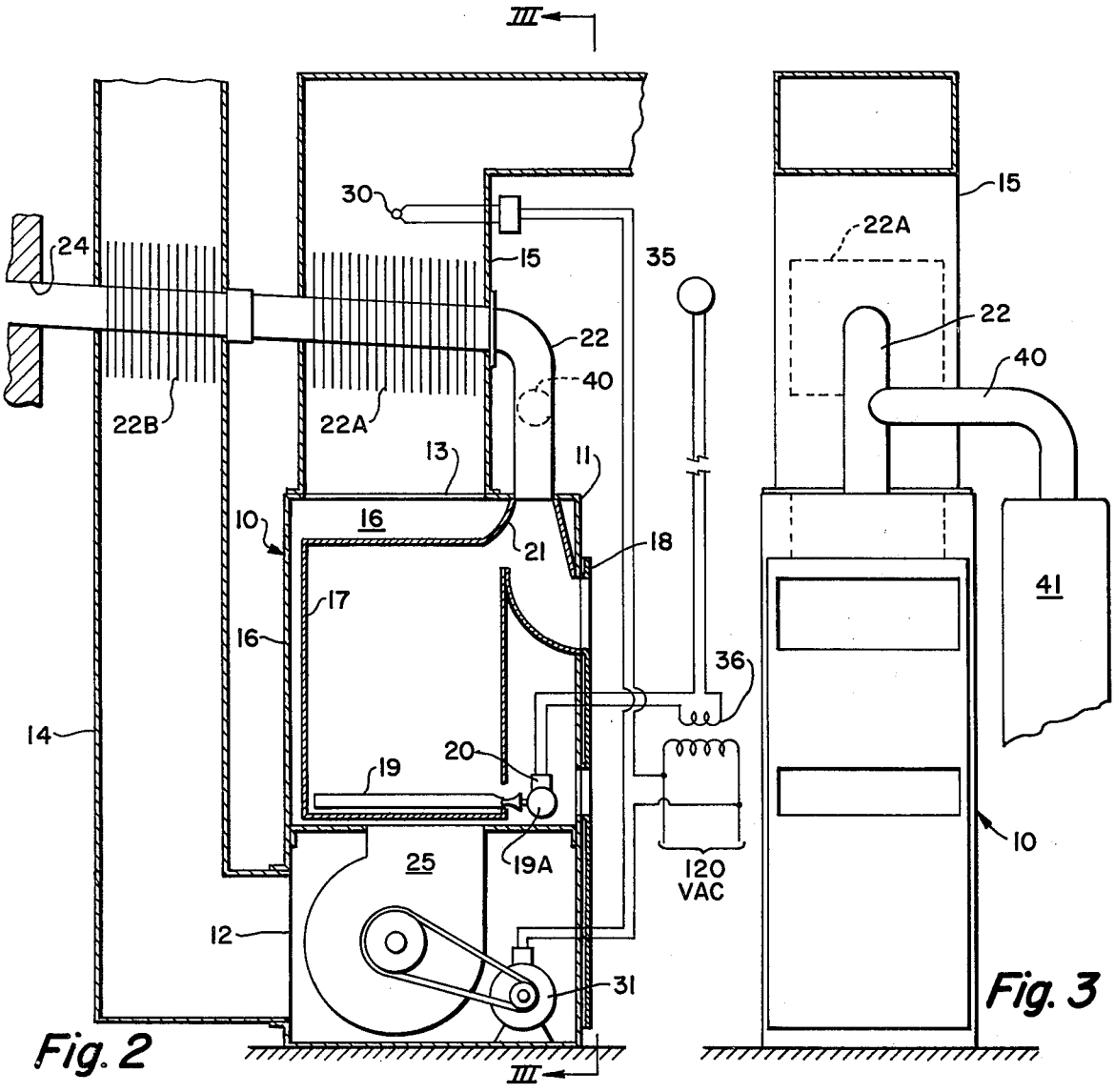
Fig. 2
Fig. 3

FORCED AIR HEATING SYSTEM

BACKGROUND OF THE INVENTION

This invention relates to an improved apparatus for greater utilization of the heat produced by burning fuel within a furnace of the type commonly employed for heating domestic homes and the like. More particularly, the present invention provides that a flue pipe with heat exchange surfaces extends through the hot air plenum and through a cold air supply duct for extracting heat from flue gases before the gases are discharged into a chimney and, in combination therewith, a heat sensor to deliver a signal to turn ON a driven blower in response to the air temperature in the hot air plenum.

Family dwellings are commonly heated by forced air heating systems including a furnace wherein fuel such as oil, liquid gas or natural gas is burned within an enclosed combustion chamber which is, in turn, located within a stream of forced air to heat the air. The heated air is then conducted by a plenum chamber connected to a hot air manifold to distribute the hot air to various places in the dwelling. The burnt gases in the combustion chamber are drawn through a flue pipe into a chimney. Substantial quantities of heat are lost in the chimney with the rising currents of heated air along with the burnt gases. When natural gas is burned in the combustion chamber of a furnace, the temperature at the end of the flue pipe in the chimney is about 450° F. When oil is burned in the combustion chamber, the temperature at the discharge end of the flue pipe in the chimney is about 800° F. Since the heated air in the chimney is exhausted directly to the outside environment, there is a substantial loss of heat produced by the furnace. This lowers the efficiency of the furnace, increases the heating cost and wastes fuel. These represent serious disadvantages because of the ever-increasing cost of fuel and the decreasing fuel supplies.

The present invention greatly increases the efficiency of heating systems, particularly those commonly employed in family dwellings by utilizing residual heat in the flue pipes in the forced air system to such an extent that the temperature of the burnt gases entering the chimney is greatly reduced.

SUMMARY OF THE INVENTION

It is an object of the present invention to increase the efficiency of a hot air heating system by a greater utilization of the heat produced by the combustion of fuel in a combustion chamber.

It is another object of the present invention to provide means for utilizing residual heat carried by the burnt gases passing from the combustion chamber for the purpose of further heating air streams passing at a point beyond the combustion chamber and to preheat a cold air stream before passing into a heat transfer relation with the combustion chamber.

It is a still further object of the present invention to utilize the residual heat in burnt flue gases for forced air heating in advance of the time when forced air heating occurs by the heat generated in the walls of the combustion chamber and to further utilize the residual heat of burnt gases to supply additional heat to the air after passing from the walls of the combustion chamber.

In one form, the present invention provides a forced air heating system with a chimney comprising a furnace housing, a cold air supply duct connected to the furnace housing, a driven blower in the furnace housing receiving air from the cold air supply duct, a combustion chamber including a burner for the combustion of fuel to heat a stream of forced air delivered from the blower, a plenum chamber including a hot air distribution header located externally of the furnace housing, a flue pipe for exhausting burned gases from the combustion chamber to the chimney, the flue pipe passing through the plenum chamber downstream of the hot air distribution header and passing through the cold air supply duct for heating the streams of air passing therein by heat transfer of sensible heat from the burnt gases, sensor means responsive to the temperature of the air passing in the hot air distribution header beyond the flue pipe for controlling the driven blower, and control means for producing a command signal for the delivery of fuel to the burners.

If desired, the flue pipe is coupled to a flue pipe used to discharge burnt gases from a water heater. The arrangement of parts is such that sensible heat is extracted from the burnt gases delivered from the water heater as well as from the furnace.

These features and advantages of the present invention as well as others will be more apparent when the following description is read in light of the accompanying drawings, in which:

FIG. 1 is a plan view of a heating system embodying the features of the present invention;

FIG. 2 is a sectional view taken along line II—II of FIG. 1 including a simplified control circuit;

FIG. 3 is a side elevational view taken along line III—III of FIG. 1; and

FIG. 4 is a plan view of a modified form of heat exchanger for the heating system shown in FIG. 1.

In FIGS. 1-3, there is illustrated a forced hot air heating system using natural gas as a combustion fuel. Those skilled in the art will readily appreciate that the features of the present invention may be incorporated in heating systems using various other types of fuel for heating family dwellings and the like. The heating system of the present invention includes a furnace 10 having a furnace housing 11 with two portal openings 12 and 13. Opening 12 communicates with a cold air supply duct 14 arranged vertically to conduct cold air from a location above the furnace downwardly to the lower portion of the furnace housing. The portal opening 13 is located on the top of the housing 11 and communicates with a hot air plenum 15 forming part of the hot air distribution system.

The hot air plenum extends into the housing 11 where it is defined by the space between side walls 16 and a combustion chamber 17. The combustion chamber is closed to the plenum chamber. Slots in an access door 18 supply air to the combustion chamber.

The combustion chamber 17 includes a burner 19 connected to a gas supply line 19A. Located in this line is a solenoid-operated valve 20. At the front of the combustion chamber and opening out of the top wall thereof, there is a flue duct 21 extending vertically in the housing 11. Beyond the top of the furnace housing, the flue duct is connected to a flue pipe 22 in the usual manner. In accordance with the present invention, the flue pipe does not pass directly into a chimney, but instead the flue pipe 22 passes through the side wall of the hot air plenum 15. In the plenum, the flue pipe supports heat transfer fins 22A. These fins are thin, flat plates welded or otherwise secured to the flue pipe in a closely, spaced-apart relation to increase the surface area for conductive transfer of sensible heat from the flue gases. This flue pipe construction is particularly desirable because it avoids undue restriction to the flow of burnt flue gases. A normally-sufficient chimney draft will avoid stagnation of flue gas in flue pipe 22 as it extends through the hot air plenum 15 and, as will be described, the cold air duct 14.

The flue pipe extends from the side wall of the hot air plenum 15 from where it passes through the side wall of the cold air return duct 14. Within the duct 14, the flue pipe is again provided with heat transfer fins 22B in essentially the same manner as just described in regard to fins 22A. The flue pipe exits from the side wall of the cold air return duct 14 and passes directly to the chimney opening 24 for exhausting the flue gas. As described heretofore, the temperature of the flue gas passing into the chimney is greatly reduced and may be as low as 140° F. This greatly increases the efficiency of the heating system.

Air to be heated is drawn downwardly through the cold air duct 14 by a blower 25 located at the bottom of the furnace. The blower forces air upwardly about the outer surface of the combustion chamber 17 where it is heated. The air continues to pass upwardly through the hot air plenum 15 where additional heating of the air occurs upon impinging contact with the heat transfer fins 22A of the flue pipe. Extending into the plenum 15 at a spaced location above the fins on flue pipe 22 is a temperature responsive motor controller 30 for a blower motor 31 forming part of the furnace control system according to the present invention. The motor controller 30 includes an adjustable control for setting the temperature at which the blower is turned ON and OFF. The motor controller is connected in series in a power supply line at a standard house current. A thermostat 35 is used to provide a signal to commence the forced air heating. This signal is produced by connecting the thermostat in series with the secondary winding of a step-down transformer 36. When the contact points in the thermostat close, a low voltage is delivered to the solenoid to open valve 20 and thereby supply gas to the burners. Thereafter, combustion takes place in the combustion chamber. The motor controller 30 responds to the temperature of the air rising from the heat exchange fins 22A so that when the temperature in the hot air plenum has attained a predetermined temperature, the motor 31 is turned ON, thus commencing the forced air heating. It is an important feature of the present invention that the motor controller is arranged above the heat exchanger fins in the hot air plenum to turn the furnace blower ON as soon as the temperature in the plenum chamber is increased to a predetermined level. In this manner, forced air heating takes place very shortly after the gas is turned ON to the burner using the heat exchange fins in the cold air duct and the hot air plenum as the principal source of heat during this period of time. Thereafter, the forced air stream passing from the chamber 19, after heating by contact with the hot walls of the combustion chamber, receives additional quantities of heat as the air stream passes between the fins on the flue pipe. The heat supplied to the forced air stream is also supplemented throughout the operation of the blower by heat transfer fins in the cold air return duct 14. The efficiency of the heating system is greatly improved by utilizing to the greatest possible extent the quantities of heat carried along with the flue gas in the flue pipe.

An additional source of heat for the heating system is supplied, if desired, by connecting a flue pipe 40 for a water heater 41 to the flue pipe 22. As shown in FIGS. 1–3, the interconnection of the flue pipe 40 with the flue pipe 22 is downstream of the plenum 15 but above the top of the furnace housing. In this way, the sensible heat of flue gases from the water heater is transferred to the hot air plenum and the cold air supply duct 14.

FIG. 4 illustrates a flue pipe 43 including spaced-apart and parallel header pipes 44. Heat exchange fins take the form of thin, flat heat exchange plates 45 secured at closely-spaced locations to the header pipes 44. The fins extend parallel to the air flow and transversely to the flow of burnt gases. Preferably, the plenum 15 and cold air supply duct 14 each contains a similarly-constructed flue pipe 43 and interconnected to exhaust burnt gases into the chimney.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A forced air heating system including a chimney for exhausting burnt gases due to the burning of a fuel comprising the combination of:

a furnace housing, a cold air supply duct connected to said furnace housing, a driven blower in said furnace housing receiving air from said cold air supply duct, a plenum chamber receiving air from said driven blower, a combustion chamber including a burner for the combustion of fuel to heat the air delivered by said driven blower to said plenum chamber, a flue duct communicating with said combustion chamber for exhausting burnt gases from the furnace housing, a flue pipe extending from said flue duct through said plenum chamber and said cold air supply duct and then into said chimney for conducting burnt gases received from said flue duct to the chimney, said flue pipe including heat exchange means in said plenum chamber for withdrawing sensible heat from the burnt gases before passing into said chimney, control means secured in said plenum chamber at a spaced location above said flue pipe passing therethrough to respond to the temperature of the air heated by said flue pipe while passing upwardly through said plenum chamber for controlling said driven blower, and a thermostat means providing a signal for the delivery of fuel to said burner.

2. The heating system according to claim 1 wherein said flue pipe includes heat exchange means in said cold air supply duct for withdrawing sensible heat from the burnt gases passing into said chimney.

3. The heating system according to claim 1 wherein said heat exchange means includes heat transfer fins secured to the walls of said flue pipe.

4. The heating system according to claim 3 wherein said flue pipe within said cold air supply duct includes heat transfer fins secured to the walls of said flue pipe.

5. The heating system according to claim 1 further comprising means to deliver burnt gases into said flue pipe apart from said combustion chamber for withdrawal of sensible heat by said heat exchange means.

6. The heating system according to claim 1 wherein the length of said flue pipe within said plenum chamber includes spaced-apart header pipes, and heat transfer fins secured to said header pipes to extend tranversely to the flow of burnt gases therein.

7. The heating system according to claim 1 wherein the length of said flue pipe within said cold air supply duct includes spaced-apart header pipes, and heat transfer fins secured to said header pipes to extend tranversely to the flow of cold air therein.

* * * * *